US006047420A

United States Patent [19]

Priester, III et al.

[11] Patent Number: 6,047,420

[45] Date of Patent: Apr. 11, 2000

[54] AXILLARY PRONE POSITION SUPPORT SYSTEM

[75] Inventors: Louis Orr Priester, III, Homewood; Robert Edward Morris, Birmingham, both of Ala.

[73] Assignee: Proper Position, Inc., Birmingham, Ala.

[21] Appl. No.: 08/977,850

[22] Filed: Nov. 25, 1997

[51] Int. Cl.[7] ..... A61G 13/12

[52] U.S. Cl. ..... 5/632; 5/638; 5/657; 5/655.9

[58] Field of Search ..... 5/630, 632, 638, 5/640, 725, 652, 652.1, 657, 643, 655.9, 631

[56] References Cited

U.S. PATENT DOCUMENTS

| | | | |
|---|---|---|---|
| 2,810,920 | 10/1957 | Carruth . | |
| 3,828,377 | 8/1974 | Eary, Sr. . | |
| 3,913,155 | 10/1975 | Eary, Sr. . | |
| 3,946,452 | 3/1976 | Eary, Sr. . | |
| 4,382,306 | 5/1983 | Lickert | 5/631 X |
| 4,531,247 | 7/1985 | Eary, Sr. . | |
| 5,014,375 | 5/1991 | Coonrad et al. | 5/631 X |
| 5,269,035 | 12/1993 | Hartunian . | |
| 5,297,303 | 3/1994 | Stafford et al. | 5/632 X |
| 5,408,713 | 4/1995 | Stratton et al. . | |
| 5,504,953 | 4/1996 | Singer-Leyton et al. . | |
| 5,566,682 | 10/1996 | Yavitz | 5/630 X |
| 5,632,050 | 5/1997 | Zajas et al. . | |
| 5,652,981 | 8/1997 | Singer-Leyton et al. | 5/631 |
| 5,661,860 | 9/1997 | Heitz . | |

*Primary Examiner*—Michael F. Trettel
*Attorney, Agent, or Firm*—Kenneth M. Bush; Robert J. Veal; Veal & Bush, LLC

[57] ABSTRACT

A head and upper body support system comprising three distinct supports: a head support and two upper body supports. The head support has a concave face contacting surface to receive the forehead of an individual therein. Each upper body support has an inclined lower portion to support and gradually lift the abdomen of the individual and an upper portion to support the corresponding shoulder, axilla (underarm), and side of the upper body. The upper portion of each upper body support has an arcuate groove formed in the side thereof to contour the axilla, which prevents the support from pressing against the breasts or chest of the individual or impeding the expansion thereof during breathing. The supports are preferably unattached so that orientation of the supports relative to each other is easily done to conform to the particular dimensions of the individual, to allow attainment of a variety of body postures to promote compliance with any prone positioning requirement, and to insure adequate air flow around the individual's face. The support system can include an optional base template to which the particular supports can be flexibly attached to maintain their positions relative to each other. Each support preferably comprises two layers of polymer foam, a body-contacting layer which is soft and flexible for comfort, and an underlying layer having greater density for stability, support, and shock absorbency. Alternatively, the supports can be fluid inflatable. The supports preferably have a protective cover which can be easily removed for cleaning.

24 Claims, 7 Drawing Sheets

AXILLARY PRONE POSITION SUPPORT SYSTEM

FIELD OF THE INVENTION

The present invention relates to head and upper body support systems. More particularly, the present invention relates to a system designed to support a person in a substantially face down position during post surgical recuperation or for other purposes requiring prone positioning.

BACKGROUND OF THE INVENTION

Following certain surgical procedures, the patient is required to lay face down in a substantially prone position. For example, during retinal reattachment surgery, a gas bubble is introduced into the eye. The bubble serves, inter alia, to promote proper healing by keeping vitreous cavity fluid substantially away from the macular region or other retinal defects during the healing process, however, the patient must remain in a face down position to maintain the bubble against the retina in the back of the eye. The gas bubble is slowly absorbed into the bloodstream as the retinal defects heal, which typically takes between 3 days to 3 weeks but can take even longer in certain cases. During this time, the patient is required to maintain a face down position during the entire absorption period, even while sleeping. Failure to maintain a face down position can lead to improper retinal healing and/or retinal re-detachment. Further, should the gas bubble come in contact with the lens of the eye, it may lead to lens opacity or cataract. Any of these complications may require surgery to correct or may even lead to blindness. Thus, it is imperative that the patient comply with the requirement of maintaining a face down position during the gas absorption period of the healing process.

However, lying or sitting in a face down position for an extended period of time becomes quite uncomfortable and can strain the back and neck muscles. Various devices exist which are designed to support an individual in a substantially face down or prone position, such as devices used in massage therapy, but these are typically designed for short term use only. For example, prior art devices designed to support a person's upper body typically support the person in the chest and shoulder regions. This can become quite uncomfortable because it restricts the person's chest and breathing, and requires intransigent shoulder placement. Other prior art devices for the most part comprise a donut-shaped pillow for receiving the face of a person therein. In these devices, the internal border of the pillow tends to press against the periphery of the eye region of the person's face. In the case of retinal re-attachment surgery, the eye region of the patient is traumatized and very sensitive, and the patient is usually directed to maintain a protective covering over the eye even while sleeping. As a result, these donut-shaped pillows are typically quite uncomfortable to the patient and may even be harmful. Further, the hole in these donut-shaped devices can cause claustrophobia and restricted breathing when used for prone positioning, leading to what has been reasonably described as "tyranny of the hole". Since a patient will require sleep throughout the gas absorption period, which may last up to several weeks, the support system must be comfortable or the patient will abandon the face down position while sleeping without being consciously aware of it.

Other shortcomings seen in prior art devices include designs which are not easily adaptable to support individuals of various shapes and sizes, and no adequate support devices exist which can be conveniently transferred between different horizontal environments, such as from a bed to a table. Moreover, these prior art devices are not true support "systems" since they have limited positioning and are not adequately adjustable to achieve the broad range of positioning required to support individuals of various shapes and sizes in a variety of body orientations. Since the ability to comfortably sit or lie down in a face down position is a key feature to promote compliance with any prone positioning requirement, what is needed is a head and upper body support system which overcomes the shortcomings in the prior art and which addresses the particular needs of a person required to maintain a facial prone position for prolonged periods.

SUMMARY OF THE PRESENT INVENTION

It is the primary object of the present invention to provide a head and upper body support system designed to comfortably support an individual lying or sitting in a facial prone position for an extended period of time.

It is another object of the present invention to provide a head and upper body support system which does not restrict the breasts or chest of the individual or impede the expansion thereof during breathing.

It is another object of the present invention to provide a head and upper body support system designed to be used on any substantially horizontal surface, such as a bed, floor, table, or the like.

It is another object of the present invention to provide a bead and upper body support system which can be conveniently transferred between different horizontal surfaces.

It is another object of the present invention to provide a head and upper body support system which is easily adaptable to support individuals of various shapes and sizes.

It is another object of the present invention to provide a head and upper body support system which is adjustable to support individuals in various body orientations to maximize comfort and promote compliance with any prone positioning requirement.

It is another object of the present invention to provide a head and upper body support system which does not impede air flow around the individual's face or promote claustrophobic sensations.

It is another object of the present invention to provide a head and upper body support system which does not impinge upon the periocular region of the individual's face.

These and other objects of the present invention are accomplished through the use of a head and upper body support system comprising three distinct supports: a head support and two upper body supports. The head support has a concave face-contacting surface to receive the forehead of an individual therein. The upper body supports are mirror images of each other, with each upper body support having an inclined lower portion to support and gradually lift the abdomen of the individual and a novel upper portion to support the corresponding shoulder, axillary region (underarm), and side of the upper body. The upper portion of each upper body support has an arcuate groove formed in the side thereof to contour the axilla, which prevents the support from pressing against the breasts or chest of the individual or impeding the expansion thereof during breathing. The supports are preferably unattached so that orientation of the supports relative to each other is easily done to conform to the particular dimensions of the individual, to allow attainment of a variety of body postures to promote compliance with prolonged prone positioning requirements, and to insure adequate air flow around the individual's face. However, the supports can be connected to each other by straps, cords, or the like. The support system can include an optional base template to which the particular supports can be flexibly attached to maintain their positions relative to each other. Each support preferably comprises two layers of polymer foam, a body-contacting layer which is soft and flexible for comfort, and an underlying layer having greater density for stability, support, and shock absorbency. Alternatively, the supports can be fluid inflatable, which also allows the supports to be stored and transported in a compacted state. The supports preferably have a protective cover which can be easily removed for cleaning. The cover can be designed such that it connects the particular supports to form a unitary, flexibly oriented structure.

These and other objects and advantages of the invention will become apparent from the following detailed description of the preferred embodiment of the invention.

BRIEF DESCRIPTION OF THE DRAWINGS

A head and upper body support system embodying features of the invention is described in the accompanying drawings which form a portion of this disclosure and wherein.

DETAILED DESCRIPTION OF THE PREFERRED EMBODIMENT

Figure 1:
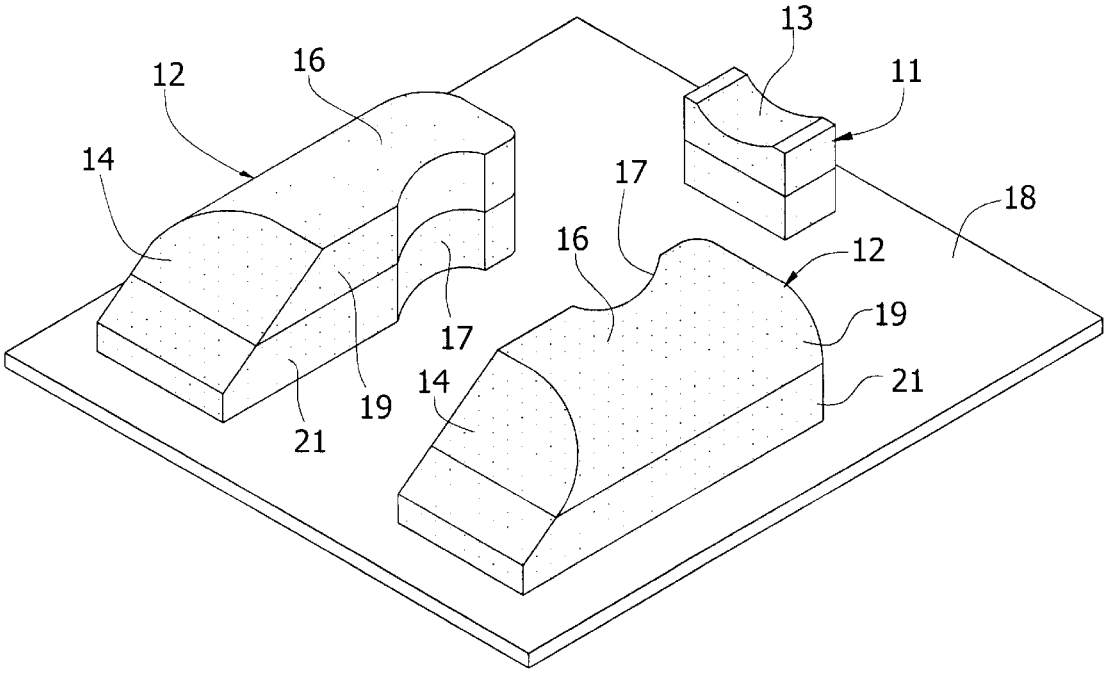
FIG. 1 is a perspective view of the support system attached to a template.

A more complete understanding of the present invention may be obtained by reference to the accompanying drawings. The invention is a head and upper body support system designed to comfortably support a person in a face down position. According to the preferred embodiment, best illustrated in FIG. 1, the support system includes a head support 11 and two upper body supports 12. The head support 11 has a concave face-contacting surface 13 to receive the forehead of a person therein. The upper body supports 12 are mirror images of each other, with each support 12 having an inclined lower portion 14 to support and gradually lift the abdomen of the person, and a substantially flattened upper portion 16 to support the corresponding shoulder, axillary region (underarm), and side of the person's upper body. The upper portion 16 preferably supports the person's upper body in a slightly elevated position relative to the person's head to properly position the head and upper body relative to each other. The upper portion 16 of each upper body support 12 has an arcuate groove 17 formed in the side facing the person which is designed to fit the contour of the axilla and prevent the support 12 from pressing against the breasts or chest of the person or impeding the expansion thereof during breathing. This feature, missing in prior art devices, substantially increases the comfort of the support system to the person. The support system can include an optional base template 18 to which the individual supports 11,12 can be attached to maintain their positions relative to each other in a flexible fashion. The template 18 preferably comprises a flexible fabric serving solely for attachment of the individual supports 11,12, but can comprise a hardened material, such as plastic or wood, if a rigid support is desired. The supports 11,12 are preferably attached to the template 18 with hook and loop fastener material (not shown), such as the hook and loop fastener material sold under the trademark VELCRO.

Figure 8:
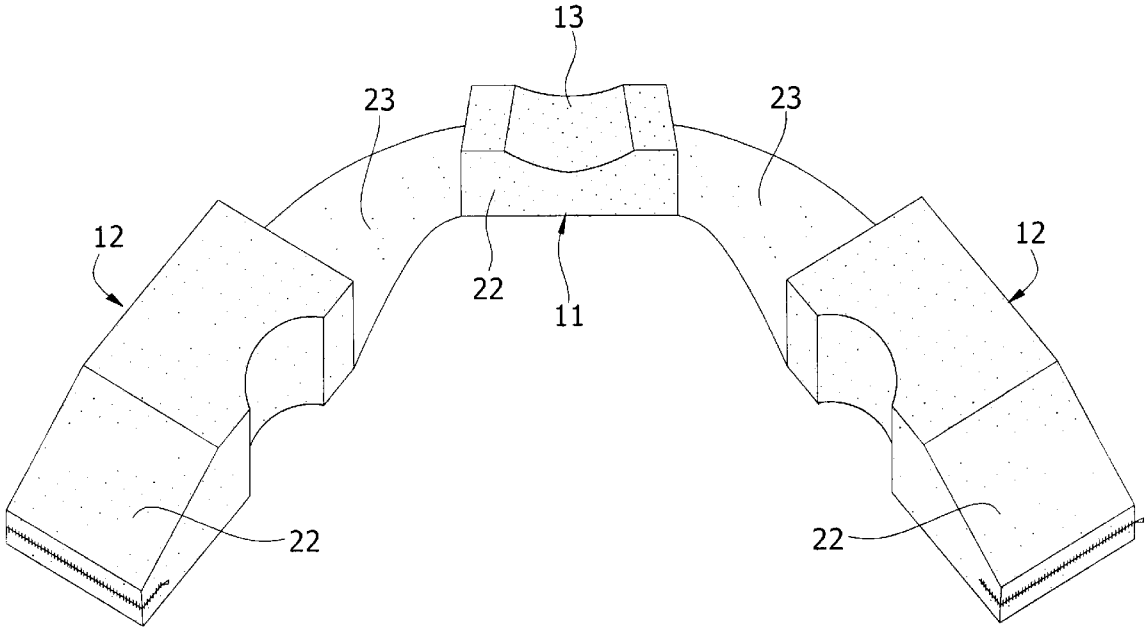
FIG. 8 is a perspective view of the support system with a protective cover thereon connecting the individual supports.

Each support 11,12 comprises a resilient material, preferably a polymer foam, such as polyurethane, having two layers, a body-contacting layer 19 which is soft and flexible for comfort, and an underlying layer 21 having greater density for stability, support, and shock absorbency. Alternatively, the supports can have any number of resilient layers of various densities or can be fluid inflatable, which also allows the supports to be stored and transported in a collapsed state. The supports 11,12 are preferably unattached so that orientation of the supports 11,12 relative to each other is easily done to conform to the particular dimensions of the person, to allow attainment of a variety of body postures to promote compliance with any prone positioning requirement, and to insure adequate air flow around the person's face. The open area around the face also permits use of breathing tubes if these devices are necessary. The supports 11,12 preferably have a protective cover 22 thereover which can be easily removed for cleaning The appropriate mating surface of the hook and loop fastener material, if present, would be attached to the outer surface of the cover for attachment to the respective mating surface on the template 18. The cover 22 preferably comprises a stretchable fabric which is fluid proof, bacteria resistant, tear resistant, and non-allergenic. For example, a healthcare fabric available from Herculite Products, Inc. (York, PA) under the trademark STAPH-CHEK® SYNERGY may be used for the cover. The cover 22 can be designed such that it connects the individual supports 11,12 with straps 23 or the like, shown in FIG. 8. Alternatively, the supports 11,12 can be directly connected (not shown) to each other by foam, fabric, rubber cords, or other means.

Figure 2:
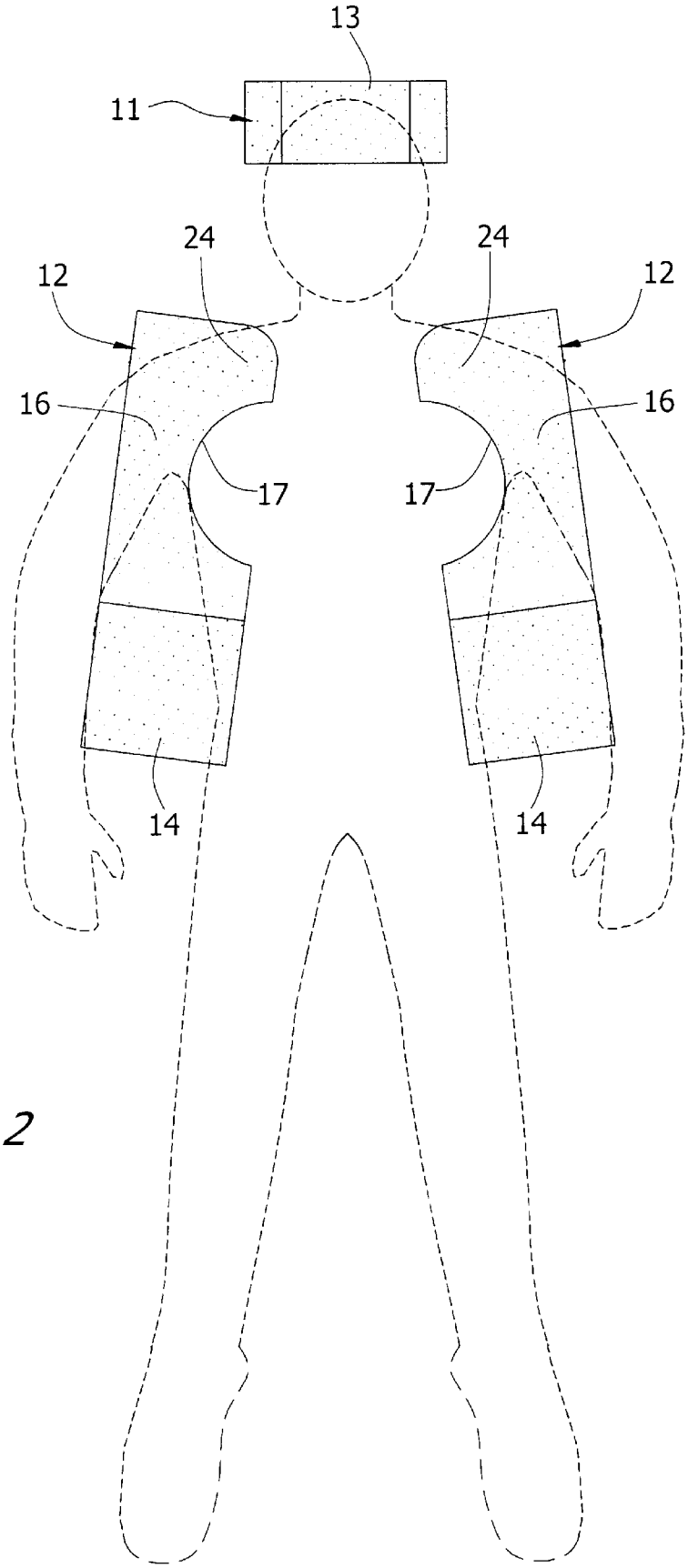
FIG. 2 is a top planar view of the support system with a person lying in a face down position superimposed thereon.
Figure 3:
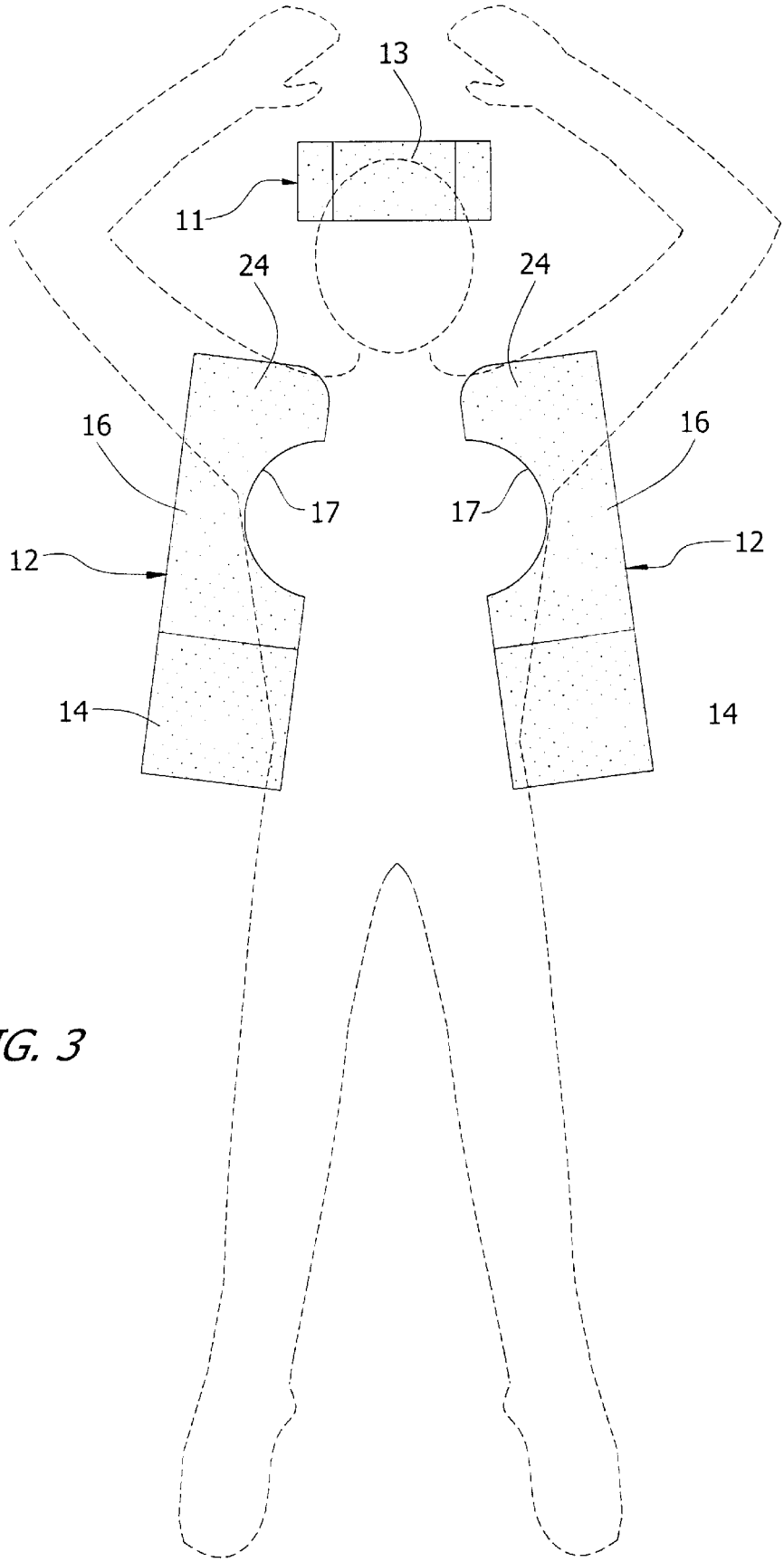
FIG. 3 is a top planar view of the support system with a person lying in an alternate face down position superimposed thereon.
Figure 4:
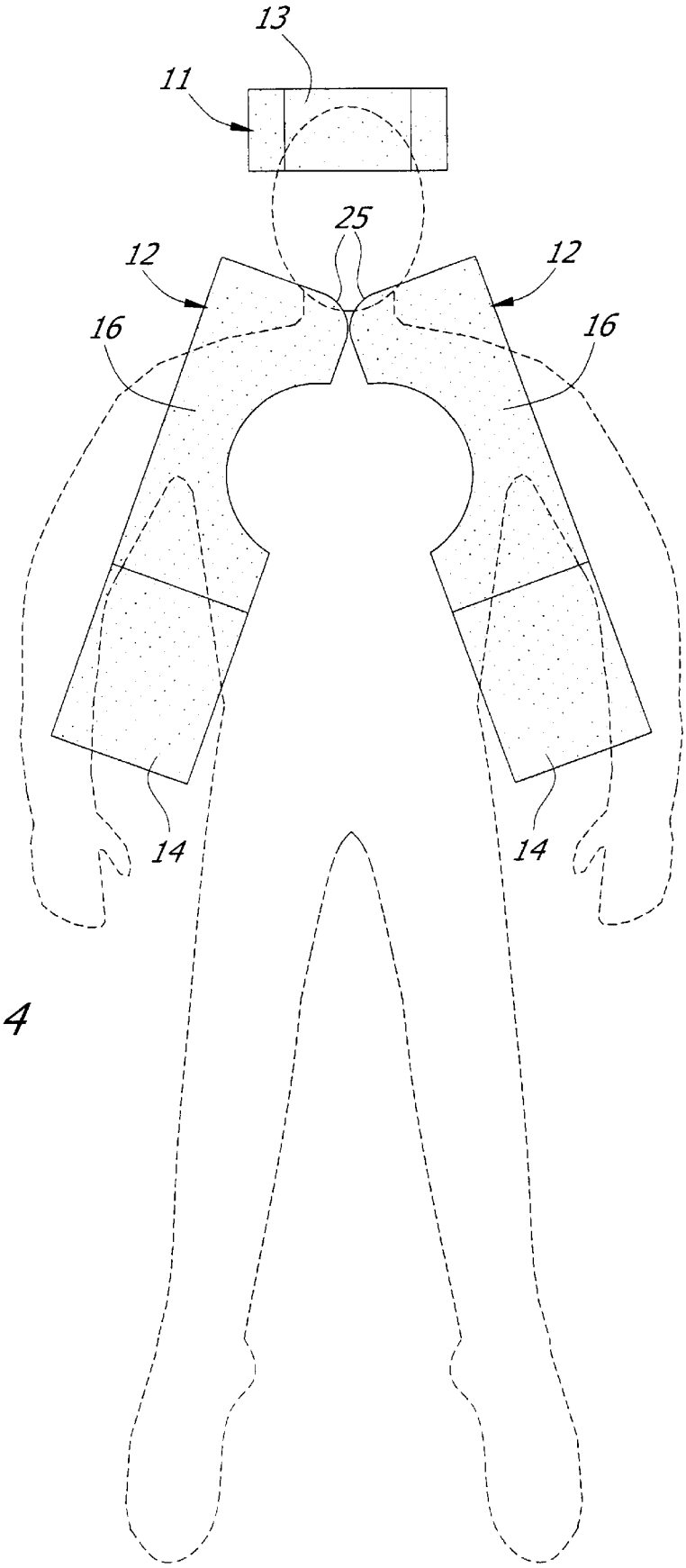
FIG. 4 is a top planar view of the support system with a person lying in an alternate face down position superimposed thereon.
Figure 5:
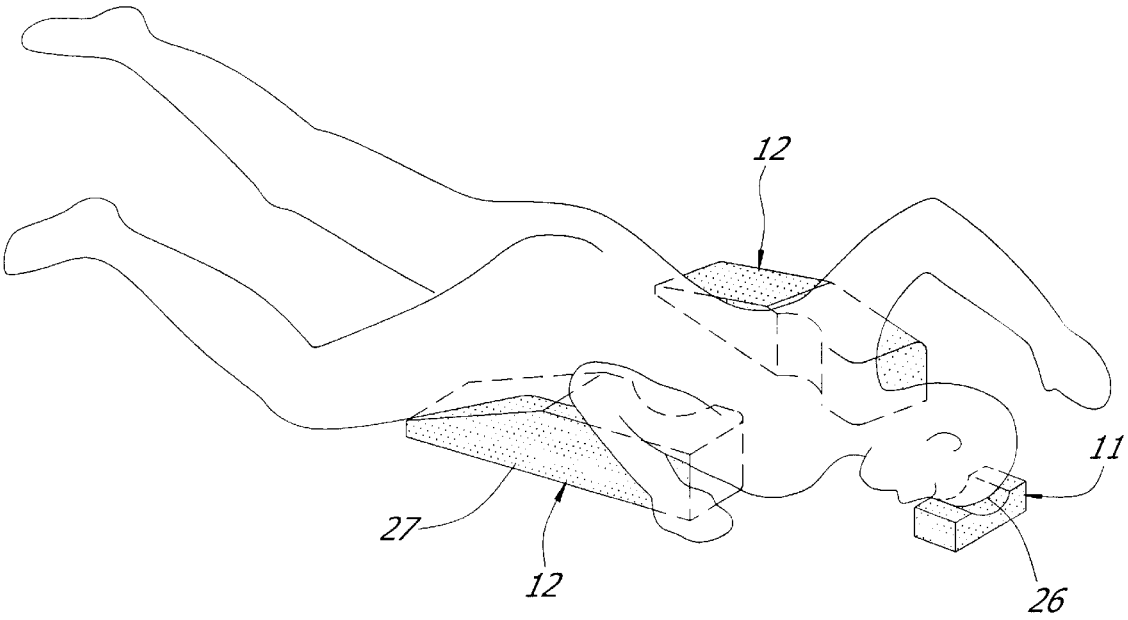
FIG. 5 is a perspective view of the support system with a person lying in an alternate substantially face down position thereon.
Figure 6:
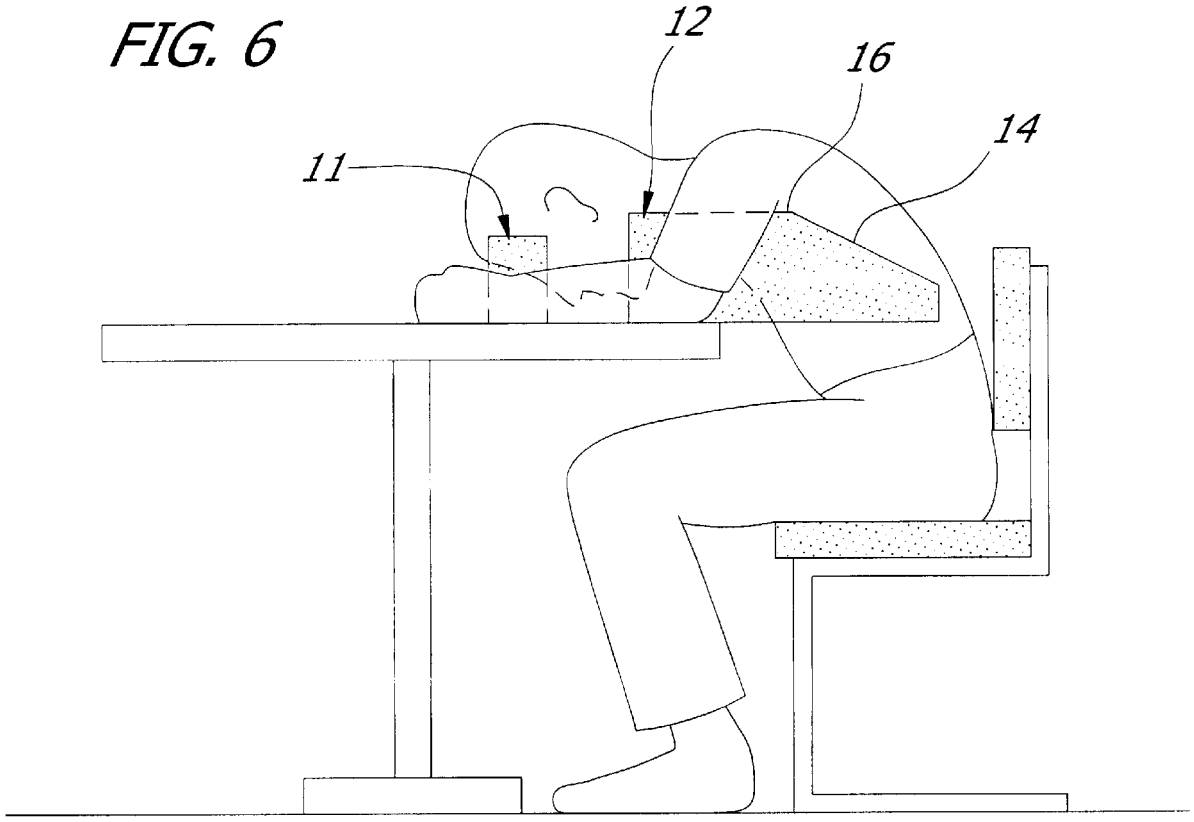
FIG. 6 is a side view of the support system with a person sitting in a face down position thereon.
Figure 7:
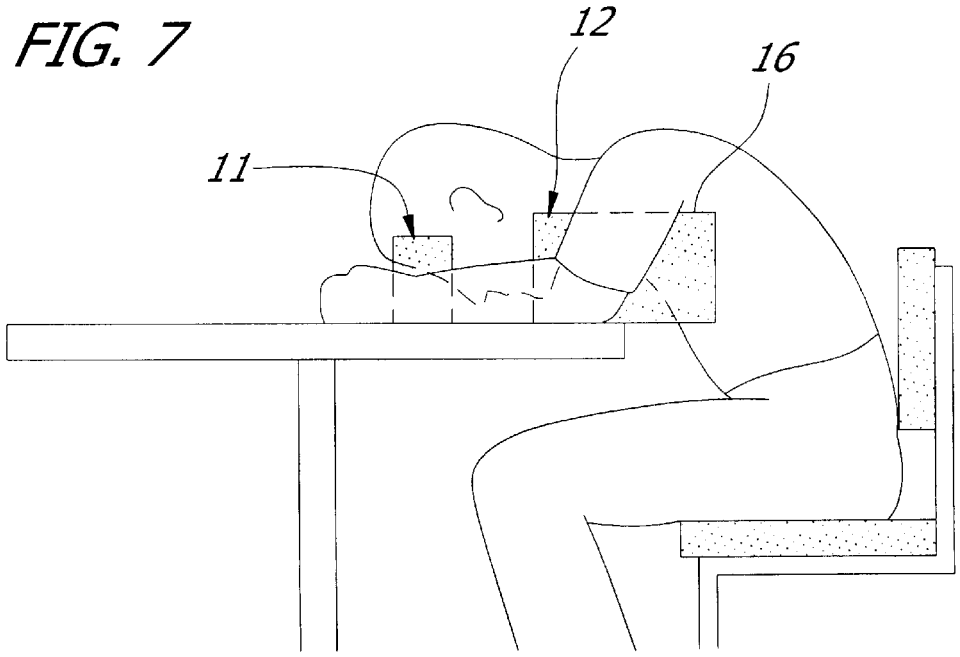
FIG. 7 is a side view of an alternate embodiment of the support system with a person sitting in a face down position thereon.

FIGS. 2 and 3 illustrate proper orientation of the support system relative to a person's body while lying in a face down position. Because the shoulder is properly supported at position 24 and the arcuate groove 17 allows support of the axilla without restricting the person's breasts or chest, the support system allows the arms to be comfortably placed in a lowered position (FIG. 2) or in a raised position (FIG. 3). This permits support to the axillary region with little risk of applying excessive pressure to the brachial nerve plexus or lymphatic tissues in the region. This is a substantial improvement over prior art devices which do not provide axillary support, but rather rely on intransigent shoulder and arm placement. Other orientations that the axillary support system comfortably supports include wherein the upper inside portions 25 of the upper body supports 12 are juxtaposed such that the person can place their chin thereon, illustrated in FIG. 4. Another is where the person's head is slightly rotated within the head support 11, illustrated at position 26 in FIG. 5. Further, where the person desires to shift their weight to either side on occasion to avoid fatigue, the support 12 on the opposite side can be lowered relative to the person's body (position 27 in FIG. 5) to comfortably support the pelvic region. Moreover, the support system can be easily and quickly moved from a bed to a table to support the person thereon. FIGS. 6 and 7 illustrate the support system being utilized at a table. When used in a seated position, the lower portions 14 of the upper body supports 12 are preferably rotated slightly outward such that the upper body supports 12 are not supporting the abdomen or sides of the upper body of the person but are directly and almost exclusively supporting the upper body via the axillary regions. FIG. 7 shows an alternate embodiment of the support system wherein the inclined portions 14 of the upper body supports 12 are not present. This embodiment is preferably used only when the person is in the seated position.

While the principal body positions utilizing the support system of the present invention have been described herein, several other body positions can be comfortably attained using the present invention as well, allowing the individual to effectively "swim" in bed without sacrificing upper body support to achieve prone positioning. Further, additional supports can be incorporated into the present system to enhance comfort, such as common house pillows to support the abdomen or legs of the user.

It is to be understood that the form of the invention shown is a preferred embodiment thereof and that various changes and modifications may be made therein without departing from the spirit of the invention or scope as defined in the following claims.

Having set forth the nature of the invention, what is claimed is:

1. An apparatus for supporting a person for extended periods in a face down position, comprising:

a. a flexible template:

b. means for supporting the person's head; and c. a pair of distinct upper body supports, wherein each of said upper body supports includes a substantially rectangular base and wherein each upper body support comprises an elongated resilient material having an arcuate groove formed in a size thereof corresponding to the contour of the person's axilla, breast, and chest, said upper body supports being capable of supporting the person's upper body without restricting the person's chest or expansion thereof during breathing by providing axillary support and without contacting the person's breasts or chest, wherein said supporting means and said upper body supports are individually capable of being repositioned on said flexible template relative to each other to adapt to changing positions and the size of the person in order to maximize comfort and support.

2. An apparatus according to claim 1 wherein said supporting means comprises a resilient material having a concave face-contacting surface to receive the forehead of the person therein.

3. An apparatus according to claim 1 wherein each of said upper body supports has an inclined lower portion to support and gradually lift the abdomen of the person.

4. An apparatus according to claim 1 further comprising a template for attachment of said supporting means and said upper body supports thereon to maintain flexible relative positions of said supporting means and said upper body supports to each other.

5. An apparatus according to claim 1 wherein said resilient material comprises a polymer foam.

6. An apparatus according to claim 1 wherein said resilient material is fluid inflatable.

7. An apparatus according to claim 1 further comprising a removable protective cover for placement over said supporting means and said upper body supports, said cover comprising a washable, stretchable fabric.

8. An apparatus for supporting a person in a face down position, comprising:

a. means for supporting the person's head;

b. a pair of substantially rectangular upper body supports, wherein each of said supports comprises an elongated resilient material having an arcuate groove formed in a side thereof corresponding to the contour of the person's axilla, breast, and chest, said supports being capable of supporting the person's upper body without restricting the person's chest or expansion thereof during breathing by providing axillary support and without contacting the person's breasts or chest; and c. a template for attachment of said supporting means and said upper body supports thereon to maintain flexible relative positions of said supporting means and said upper body supports to each other, wherein said template comprises a flexible fabric.

9. An apparatus for supporting a person in a face down position, comprising:

a. means for supporting the person's head;

b. a pair of substantially rectangular upper body supports, wherein each of said supports comprises an elongated resilient material having an arcuate groove formed in a side thereof corresponding to the contour of the person's axilia, breast, and chest, said supports being capable of supporting the person's upper body without restricting the person's chest or expansion thereof during breathing by providing axillary support and without contacting the person's breasts or chest; and c. a template for attachment of said supporting means and said upper body supports thereon to maintain flexible relative positions of said supporting means and said upper body supports to each other, wherein said template comprises a rigid material.

10. An apparatus for supporting a person in a face down position, comprising:

a. means for supporting the person's head;

b. a pair of substantially rectangular upper body supports, wherein each of said supports comprises an elongated resilient material having an arcuate groove formed in a side thereof corresponding to the contour of the person's axilla, breast, and chest, said supports being capable of supporting the person's upper body without restricting the person's chest or expansion thereof during breathing by providing axillary support and without contacting the person's breasts or chest; and c. a template for attachment of said supporting means and said upper body supports thereon to maintain flexible relative positions of said supporting means and said upper body supports to each other, wherein said supporting means and said upper body supports are attached to said template with hook and loop fastener material.

11. An apparatus for supporting a person in a face down position, comprising:

a. means for supporting the person's head; and b. a pair of substantially rectangular upper body supports, wherein each of said supports comprises an elongated resilient material having an arcuate groove formed in a side thereof corresponding to the contour of the person's axilla, breast, and chest, said supports being capable of supporting the person's upper body without restricting the person's chest or expansion thereof during breathing by providing axillary support and without contacting the person's breasts or chest, wherein said resilient material comprises a polymer foam having a body-contacting layer for comfort and an underlying layer having greater density for stability, support, and shock absorbency.

12. An upper body support system for supporting a person for extended periods in a face down position on a horizontal surface, comprising:

a. means for supporting the person's head; and b. a pair of distinct upper body supports, wherein each of said supports comprises a substantially rectangular-shaped resilient material having an upper portion for supporting the shoulder and axilla of the person, and an arcuate groove formed in a side thereof corresponding to the contour of the person's axilla, breasts, and chest, said supports being capable of supporting the person's upper body and pelvic area above the horizontal surface without contacting the person's breasts or chest or restricting expansion thereof during breathing, wherein said supporting means and said upper body supports are individually capable of being repositioned relative to each other to adapt to changing positions and the size of the person in order to maximize comfort and support.

13. A support system according to claim 12 further comprising a template for attachment of said supporting means and said upper body supports thereon to maintain relative positions of said supporting means and said upper body supports to each other.

14. A support system according to claim 13 further comprising a removable protective cover for placement over said supporting means and said upper body supports, said cover comprising a washable, stretchable fabric.

15. A support system according to claim 12 wherein said resilient material comprises polyurethane foam.

16. A support system according to claim 12 wherein said resilient material is fluid inflatable.

17. An upper body support system for supporting a person in a face down position on a horizontal surface, comprising:

a. means for supporting the person's head; and b. a pair of upper body supports, wherein each of said supports comprises a substantially rectangular-shaped resilient material having an upper portion for supporting the shoulder and axilla of the person, and an arcuate groove formed in a side thereof corresponding to the contour of the person's axilla, breasts, and chest, said supports being capable of supporting the person's upper body and pelvic area above the horizontal surface without contacting the person's breasts or chest or restricting expansion thereof during breathing, wherein said resilient material comprises polyurethane foam having a body-contacting layer for comfort and an underlying layer having greater density for stability, support, and shock absorbency.

18. An upper body support system for supporting a person in a face down position on a horizontal surface, comprising:

a. means for supporting the person's head;

b. a pair of upper body supports, wherein each of said supports comprises a substantially rectangular-shaped resilient material having an upper portion for supporting the shoulder and axilla of the person, and an arcuate groove formed in a side thereof corresponding to the contour of the person's axilla, breasts, and chest, said supports being capable of supporting the person's upper body and the person's pelvic area above the horizontal surface without contacting the person's breasts or chest or restricting expansion thereof during breathing;

c. a template for attachment of said supporting means and said upper body supports thereon to maintain relative positions of said supporting means and said upper body supports to each other, wherein said supporting means and said upper body supports are attached to said template with hook and loop fastener material; and d. a removable protective cover for placement over said supporting means and said upper body supports and connecting said supporting means to said upper body supports, said cover comprising a washable, stretchable fabric.

19. An upper body support system for supporting a person in a face down position on a horizontal surface, comprising:

a. means for supporting the person's head;

b. a pair of upper body supports, wherein each of said supports comprises a substantially rectangular-shaped resilient material having an upper portion for supporting the shoulder and axilla of the person, and an arcuate groove formed in a side thereof corresponding to the contour of the person's axilla, breasts, and chest, said supports being capable of supporting the person's upper body and said pelvic area above the horizontal surface without contacting the person's breasts or chest or restricting expansion thereof during breathing;

c. a template for attachment of said supporting means and said upper body supports thereon to maintain relative positions of said supporting means and said upper body supports to each other, wherein said supporting means and said upper body supports are connected to each other; and d. a removable protective cover for placement over said supporting means and said upper body supports to connect said supporting means to said upper body supports, said cover comprising a washable, stretchable fabric.

20. An axillary support system, comprising a distinct pair of supports, a head brace, and a base member, wherein each of said supports comprises a substantially rectangular-shaped resilient material having an upper portion for supporting the shoulder and axilla of a person and also the pelvic area of the person, and an arcuate groove formed in a side thereof corresponding to the contour of the person's axilla, breasts, and chest, said supports being capable of supporting the person's upper body above said base member without contacting the person's breasts or chest or restricting expansion thereof during breathing, wherein said supports and head brace are individually capable of being repositioned relative to each other on said base member to adapt to changing positions and the size of the person in order to maximize comfort and support.

21. An upper body support system for supporting a person in a face down position, comprising a head brace, a pair of supports, and a template, wherein each of said supports comprises a substantially rectangular-shaped resilient material having an arcuate groove formed in a side of said resilient material, said supports being capable of supporting the person's upper body above a horizontal surface without contacting the person's breasts or chest or restricting expansion thereof during breathing, and said head brace being capable to hold the person's head above the horizontal surface, wherein said resilient material comprises a polyurethane foam having a body-contacting layer for comfort and an underlying layer having greater density for stability, support, and shock absorbency, and wherein said head brace and said supports are independently positionable on said template to support any portion of the person's body.

22. An upper body support system for supporting a person in a face down position, a head brace, a pair of supports, and a template, wherein each of said supports comprises a substantially rectangular-shaped resilient material, said supports including an arcuate groove such that said supports are capable of supporting the person's upper body above a horizontal surface without contacting the person's breasts or chest or restricting expansion thereof during breathing, and wherein said supports and said head brace maintain flexible relative positions on said template, wherein said template comprises a flexible fabric.

23. An upper body support system for supporting a person in a face down position, a head brace, a pair of supports, and a template, wherein each of said supports comprises a substantially rectangular-shaped resilient material, said supports including an arcuate groove such that said supports are capable of supporting the person's upper body above a horizontal surface without contacting the person's breasts or chest or restricting expansion thereof during breathing, and wherein said supports and said head brace maintain flexible relative positions on said template, wherein said template comprises a rigid material.

24. An upper body support system for supporting a person in a face down position, a head brace, a pair of supports, and a template, wherein each of said supports comprises a substantially rectangular-shaped resilient material, said supports including an arcuate groove such that said supports are capable of supporting the person's upper body above a horizontal surface without contacting the person's breasts or chest or restricting expansion thereof during breathing, and wherein said supports and said head brace maintain flexible relative positions on said template, wherein said supports are attached to said template with hook and loop fastener material.

* * * * *